US011808156B2

(12) United States Patent
Nishii et al.

(10) Patent No.: US 11,808,156 B2
(45) Date of Patent: Nov. 7, 2023

(54) SECONDARY FLOW SUPPRESSION STRUCTURE

(71) Applicant: IHI Corporation, Tokyo (JP)

(72) Inventors: Daisuke Nishii, Tokyo (JP); Masaaki Hamabe, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/662,537

(22) Filed: May 9, 2022

(65) Prior Publication Data

US 2022/0259983 A1 Aug. 18, 2022

Related U.S. Application Data

(63) Continuation of application No. PCT/JP2021/005338, filed on Feb. 12, 2021.

(30) Foreign Application Priority Data

Mar. 30, 2020 (JP) ..... 2020-060319

(51) Int. Cl.
*F01D 11/08* (2006.01)
*F01D 9/02* (2006.01)

(52) U.S. Cl.
CPC ..... *F01D 11/08* (2013.01); *F01D 9/02* (2013.01); *F05D 2220/30* (2013.01); *F05D 2240/12* (2013.01); *F05D 2240/55* (2013.01)

(58) Field of Classification Search
CPC ..... F01D 5/224; F01D 5/143; F01D 5/145; F05D 2220/30; F05D 2240/12; F05D 2240/55
See application file for complete search history.

(56) References Cited

U.S. PATENT DOCUMENTS 5,632,598 A 5/1997 Maier
8,936,247 B2 * 1/2015 Zheng ..... F01D 11/16 277/420

(Continued)

FOREIGN PATENT DOCUMENTS

JP S57-8302 A 1/1982
JP S58-165201 U 11/1983

(Continued)

OTHER PUBLICATIONS

Official Action dated Mar. 14, 2023, in corresponding Japanese Patent Application No. 2022-511623, 2 pages.

(Continued)

*Primary Examiner* — Igor Kershteyn
(74) *Attorney, Agent, or Firm* — Oblon, McClelland, Maier & Neustadt, L.L.P.

(57) ABSTRACT

A secondary flow suppression structure includes: a turbine rotor blade including an outer shroud; a turbine stator vane located rearward of the turbine rotor blade and including an outer band; a seal surface facing the outer shroud at a radial outside of the outer shroud; a fin projecting from the outer shroud toward the seal surface; and a cavity formed between the seal surface and the turbine stator vane, formed in an annular shape extending in a circumferential direction, and provided with an opening portion opening radially inward on a virtual surface of the seal surface extending rearward. A front end of the outer band is positioned at the same height as the virtual surface in a radial direction, or positioned radially inward of the virtual surface.

6 Claims, 5 Drawing Sheets

(56) References Cited

U.S. PATENT DOCUMENTS

| | | | | |
|---|---|---|---|---|
| 2003/0007866 | A1* | 1/2003 | Ito | F01D 11/08 415/182.1 |
| 2004/0151582 | A1 | 8/2004 | Faulkner | |
| 2011/0070072 | A1* | 3/2011 | Subramaniyan | F01D 11/08 415/173.2 |
| 2011/0285090 | A1 | 11/2011 | Zheng | |
| 2012/0121394 | A1 | 5/2012 | Iida | |
| 2012/0224974 | A1* | 9/2012 | Iida | F01D 5/225 416/235 |
| 2012/0288360 | A1 | 11/2012 | Kuwamura et al. | |
| 2012/0321449 | A1* | 12/2012 | Matsumoto | F01D 11/02 415/173.6 |
| 2013/0266426 | A1* | 10/2013 | Mahle | F01D 5/225 415/173.1 |
| 2013/0266427 | A1* | 10/2013 | Mahle | F01D 11/127 415/173.4 |
| 2014/0056690 | A1* | 2/2014 | Sakamoto | F01D 9/045 415/115 |
| 2016/0281526 | A1 | 9/2016 | Yamazaki et al. | |
| 2017/0030213 | A1 | 2/2017 | Vlasic et al. | |
| 2017/0101882 | A1* | 4/2017 | Sippel | F01D 11/005 |
| 2018/0142587 | A1 | 5/2018 | Klingels | |
| 2020/0157957 | A1* | 5/2020 | Momma | F01D 9/041 |

FOREIGN PATENT DOCUMENTS

| | | | |
|---|---|---|---|
| JP | 2002-371802 | A | 12/2002 |
| JP | 2009-047043 | A | 3/2009 |
| JP | 2010-203302 | A | 9/2010 |
| JP | 2011-1894 | A | 1/2011 |
| JP | 2011-208602 | A | 10/2011 |
| JP | 2011-241826 | A | 12/2011 |
| JP | 2012-62863 | A | 3/2012 |
| JP | 2012-211527 | A | 11/2012 |
| JP | 2013-194519 | A | 9/2013 |
| JP | 2015-108340 | A | 6/2015 |
| JP | 2016-84730 | A | 5/2016 |
| JP | 2017-8756 | A | 1/2017 |
| JP | 2017-061888 | A | 3/2017 |
| JP | 2018-40282 | A | 3/2018 |
| JP | 2019-178636 | A | 10/2019 |
| JP | 2019-203398 | A | 11/2019 |
| JP | 2020-505555 | A | 2/2020 |
| JP | WO2020/031625 | A1 | 2/2020 |
| RU | 2 151 884 | C1 | 6/2000 |
| WO | WO 2011/090083 | A1 | 7/2011 |

OTHER PUBLICATIONS

International Search Report dated Apr. 20, 2021 in PCT/JP2021/005338 filed Feb. 12, 2021, 3 pages.

Japanese Office Action issued in Japanese Patent Application No. 2022-511623 dated May 23, 2023.

Japanese Office Action issued in Japanese Patent Application No. 2022-511623 dated Jul. 25, 2023, (w/ English translation).

* cited by examiner

SECONDARY FLOW SUPPRESSION STRUCTURE

CROSS REFERENCE TO RELATED APPLICATIONS

This application is a continuation application of International Application No. PCT/JP2021/005338, now WO2021/199718, filed on Feb. 12, 2021, which claims priority to Japanese Patent Application No. 2020-060319, filed on Mar. 30, 2020, the entire contents of which are incorporated by reference herein.

BACKGROUND

1. Technical Field

The present disclosure relates to a secondary flow suppression structure in an axial turbine.

2. Description of the Related Art

A gas turbine engine such as a jet engine is installed with an axial turbine to rotationally drive a compressor. The axial turbine has a plurality of rotor blades and a plurality of stator vanes. These are arranged alternately in an axial direction and constitute at least one stage. The rotor blades are arranged in a circumferential direction at predetermined intervals to constitute a blade cascade. Similarly, the stator vanes are arranged in the circumferential direction at predetermined intervals to constitute a vane cascade.

A tip of the rotor blade is provided with an outer shroud. A tip of the stator vane is provided with an outer band. Similarly, a hub of the rotor blade is provided with an inner shroud, and a hub of the stator vane is provided with an inner band. The outer shroud and the outer band are outer walls constituting a flow passage (main passage) of the working fluid passing through the blade cascade and the vane cascade. The inner shroud and the inner band are inner walls constituting the flow passage of the working fluid.

The rotor blade has a dovetail radially inwardly of the inner shroud. The dovetail is attached to a rotor connected to a shaft. On the other hand, the tip of the stator vane is fixed to the casing via a support member of the stator vane.

The outer shroud is separated from a seal surface located inside the casing to allow a rotation of the rotor. In this regard, a fin is provided on the outer surface of the outer shroud to suppress passing of the working fluid through this space.

SUMMARY

As described above, the fin is provided between the outer shroud of the rotor blade and the seal surface. Although the tips of the fins are as close as possible to the seal surface, they are not in contact with each other. Accordingly, as a leakage, the working fluid partially flows from the main passage into the space between the outer shroud of the rotor blade and the seal surface. The leakage passes between the outer shroud and seal surface and then returns to the main path from between the outer shroud of the rotor blade and the outer band of the stator vane.

The aforementioned leakage induces separation of the working fluid on the pressure side of the stator vane due to the impact of the leakage to a leading edge of the stator vane and the suction side in the vicinity thereof. This separation is relatively large and increases the secondary flow near the tip of the stator vane. This increase in secondary flow results in a decrease in turbine efficiency.

The present disclosure is made in view of the above circumstances. That is, it is an object of the present disclosure to provide a secondary flow suppression structure capable of suppressing an increase in secondary flow caused by a leakage in an axial turbine.

A secondary flow suppression structure according to the present disclosure includes: a turbine rotor blade including an outer shroud; a turbine stator vane located rearward of the turbine rotor blade and including an outer band; a seal surface facing the outer shroud at a radially outside of the outer shroud; and a cavity formed between the seal surface and the turbine stator vane, formed in an annular shape extending in a circumferential direction, and provided with an opening portion opening radially inward on a virtual surface of the seal surface extending rearward; wherein the outer shroud includes a fin protruding toward the seal surface.

A front end of the outer band may be positioned at the same height as the virtual surface in a radial direction, or positioned radially inward of the virtual surface. The opening portion of the cavity may be located rearward of a position where the fin and the seal surface face each other. A gap may be formed between a support member of the seal surface and a support member of the outer band, and the gap may be connected with the cavity and may have a width shorter than that of the cavity at a position where the gap is connected with the cavity.

According to the present disclosure, it is possible to provide a secondary flow suppression structure capable of suppressing an increase in secondary flow caused by a leakage in an axial turbine.

BRIEF DESCRIPTION OF THE DRAWINGS

FIGS. 4A and 4B are perspective views illustrating distributions of the secondary flow in the vicinity of the tip of the stator vane, wherein FIG. 4A illustrates the distribution when a cavity is not present, and FIG. 4B illustrates the distribution when the cavity is present.

DESCRIPTION OF THE EMBODIMENTS

Figure 1:
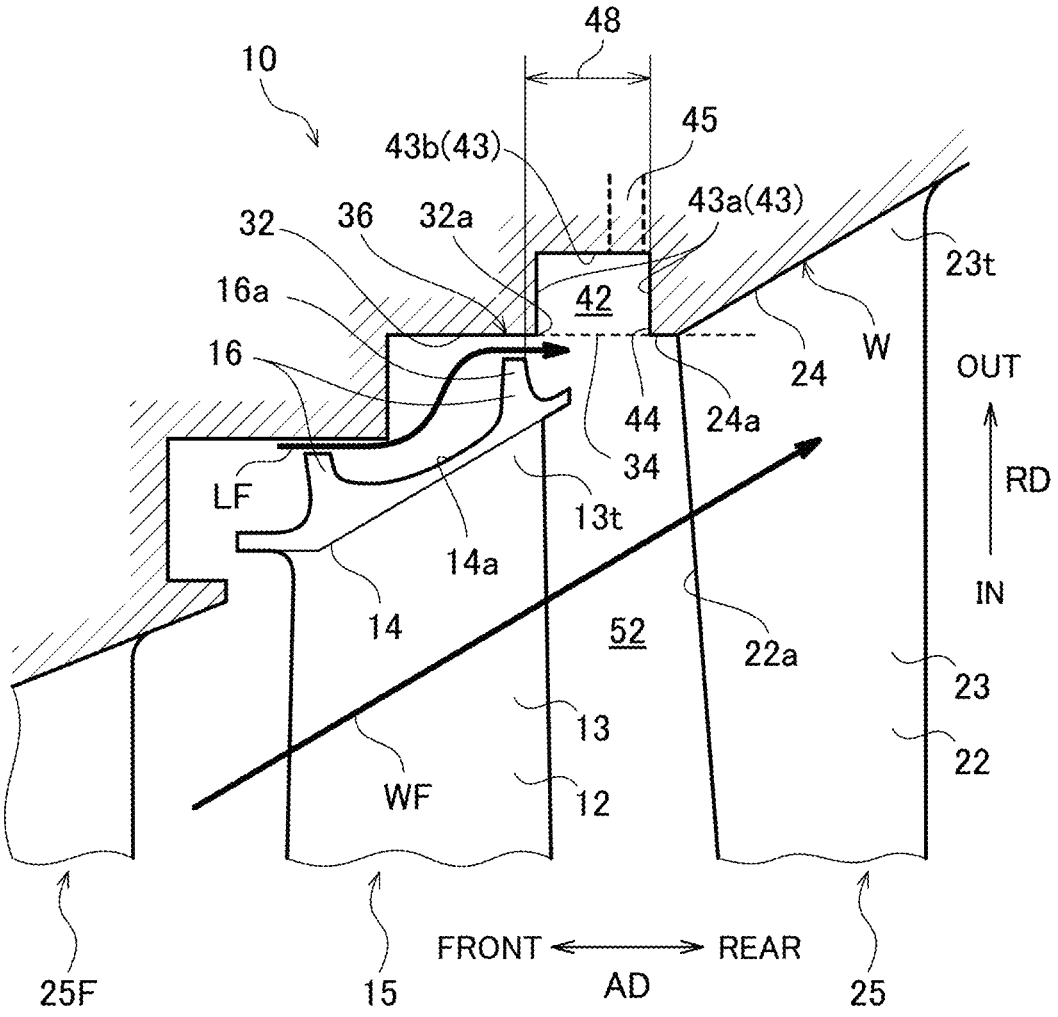
FIG. 1 is a conceptual diagram illustrating a secondary flow suppression structure according to an embodiment of the present disclosure.

Some exemplary embodiments are described below with reference to the drawings. It should be noted that the same reference numerals are given to the common parts in the respective figures, and the redundant description thereof will be omitted. A secondary flow suppression structure 10 according to the present embodiment is applied to an axial turbine of a gas turbine engine for an aircraft or an electric generator. For convenience of explanation, an extending direction of a rotational center axis of rotor blades 12 in the axial turbine is defined as the axial direction AD. A circumferential direction CD and a radial direction RD are defined around this rotational center axis. A term "forward (front)"

and a term "rearward (rear)" represent an upstream side and a downstream side of the flow of the working fluid WF, respectively.

Figure 2:
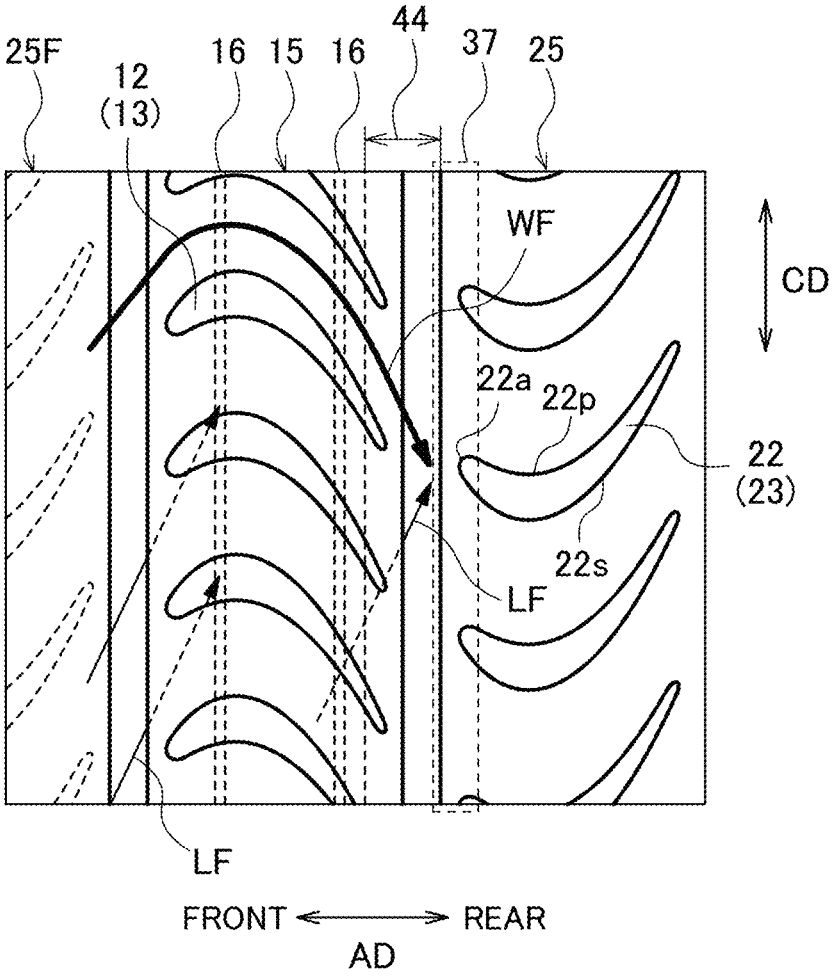
FIG. 2 is a development view illustrating a blade cascade and vane cascades along the circumferential direction.

A configuration of the secondary flow suppression structure 10 will be described. FIG. 1 is a conceptual diagram illustrating the secondary flow suppression structure 10. FIG. 2 is a development view of a blade cascade (blade row) 15 and vane cascades (vane row) 25 and 25F along the circumferential direction CD. The secondary flow suppression structure 10 according to the present embodiment includes rotor blades (turbine rotor blades) 12, stator vanes (turbine stator vanes) 22, a seal surface 32, and a cavity 42. FIG. 1 illustrates a single wall surface W which represents the seal surface 32 and an outer band 24 of the stator vane 22 in order to simply show the structure of the secondary flow suppression structure 10. Therefore, in the example shown in this figure, the cavity 42 is formed on the wall surface W.

The rotor blade 12 includes an airfoil part 13 and an outer shroud 14 provided on a tip 13*t* of the airfoil part 13 (i.e., of the rotor blade 12). The outer shroud 14 is an outer wall defining a flow passage 52 of the working fluid WF. The outer shroud 14 is integrated with the airfoil part 13. As shown in FIG. 2, the rotor blades 12 are arranged in the circumferential direction CD to constitute the blade cascade 15.

The stator vanes 22 are located rearward of the blade cascade 15. The stator vane 22 includes an airfoil part 23 and an outer band 24 provided on a tip 23*t* of the airfoil part 23 (i.e., of the stator vane 22). The outer band 24 is an outer wall defining the flow passage 52 of the working fluid WF together with the outer shroud 14. The outer band 24 is integrated with the airfoil part 23. As shown in FIG. 2, the stator vanes 22 are arranged in the circumferential direction CD to constitute the vane cascade 25.

A position (height) of the front end 24*a* of the outer band 24 along the radial direction RD can be arbitrarily set with respect to a virtual surface 34. That is, in the radial direction RD, the front end 24*a* may be positioned radially outward of the virtual surface 34, may be positioned at the same height, or may be positioned radially inward of the virtual surface 34. However, by positioning the front end 24*a* at the same position or radially inward of the virtual surface 34, it is possible to mitigate an impingement of a leakage (leak flow) LF as described later on the suction side 22*s* of the stator vane 22, compared with the case where the front end 24*a* is radially outward of the virtual surface 34.

The seal surface 32 is located radially outward of the outer shroud 14. The seal surface 32 faces the outer surface 14*a* of the outer shroud 14 and is formed in an annular shape extending in the circumferential direction CD to surround the blade cascade 15 from the radial outside. The seal surface 32 is, for example, a honeycomb seal having a known structure or a layered body having a predetermined thickness including an abrasive material.

The outer shroud 14 includes at least one fin 16. The fin 16 is integrally formed with the outer surface 14*a* of the outer shroud 14 and projects from the outer surface 14*a* toward the seal surface 32. The fin 16 extends in the circumferential direction CD from one end side to the other side of the outer shroud 14 in the circumferential direction CD. The fin 16 has a predetermined width in the axial direction AD. This width is sufficiently narrower than the width of the outer shroud 14. Thus, the fin 16 forms an annular wall on the outer surface 14*a* of the outer shroud 14 together with other fins of the other blades adjacent in the circumferential direction CD (see FIG. 2). As described above, the number of fins 16 may be one or more. However, when multiple fins 16 are provided with the outer shroud 14, the most downstream fin of them constitutes the secondary flow suppression structure 10.

The tip 16*a* of the fin 16 faces the seal surface 32 with a predetermined clearance. This clearance is sufficiently smaller than the distance between the outer surface 14*a* of the outer shroud 14 and the seal surface 32. Accordingly, the fin 16 and the seal surface 32 form a narrow portion 36. The narrow portion 36 narrows a space in the radial direction RD, which is defined by the outer surface 14*a* of the outer shroud 14 and the seal surface 32. That is, the fin 16 suppresses the flow of the leakage LF together with the seal surface 32, or control the amount of the leakage LF, while defining the clearance that allows the rotation of the rotor blades 12.

The cavity 42 is formed between the seal surface 32 and the stator vane 22 in the axial direction AD. The cavity 42 is an annular groove or recess which opens radially inward and extends in the circumferential direction CD. For example, the cavity 42 is formed in a member such as a honeycomb seal that includes the seal surface 32. The cavity 42 is also located within a region 48 between the rear end 32*a* of the seal surface 32 and the front end 24*a* of the outer shroud 14. The cavity 42 is formed of an inner peripheral surface 43 and an opening portion 44. The inner peripheral surface 43 forms an internal space of the cavity 42. The opening portion 44 opens on the virtual surface 34 which extends rearward from the seal surface 32. The opening portion 44 opens radially inward from the internal space of the cavity 42. The inner peripheral surface 43 includes, annular side surfaces 43*a* and 43*a* and a bottom surface 43*b*, for example. the annular side surfaces 43*a* and 43*a* are parallel and opposed to each other and extend in the circumferential direction CD. The bottom surface 43*b* is located radially outward of the side surfaces 43*a* and 43*a*. In this case, the cavity 42 has a rectangular cross-section. The cavity 42 may be formed entirely or partially between the rear end 32*a* of the seal surface 32 and the front end 24*a* of the outer shroud 14.

As shown in FIG. 1, the opening portion 44 of the cavity 42 is located behind the narrow portion 36. When multiple narrow portions 36 are formed with multiple fins 16, the opening portion 44 is located rearward from the most rearward one of the narrow portions 36. In other words, the opening portion 44 is closer to the front end 24*a* of the outer band 24 than the position(s) where the tip(s) 16*a* of the fin(s) 16 and the seal surface 32 face each other. That is, the cavity 42 is formed at a position (region 48) that does not interfere with the constriction of the flow caused by the narrow portion 36.

The width and depth of the cavity 42 are set to values that change the original flow (i.e., the flow when the cavity 42 is not present) of the leakage LF due to the presence of the cavity 42. The caused flow change is, for example, a swirl, a turn (deflection), a deceleration (stagnation) in and near the cavity 42. These values can be obtained by numerical analysis such as CFD (Computational Fluid Dynamics), etc. The width of the cavity is the maximum length of the cavity 42 along the axial direction AD, and is substantially the length of the opening portion 44 along the axial direction AD. The depth of the cavity 42 is the length from the opening portion 44 (virtual surface 34) of the cavity 42 along the radial direction RD to the bottom surface 43*b* of the inner peripheral surface 43.

The cross-sectional shape of the cavity 42 orthogonal to the circumferential direction CD is, for example, a rectangle shown in FIG. 1. However, the cross-sectional shape of the cavity 42 is not limited to the rectangular shape as long as the cavity 42 can change the original flow of the leakage LF.

Figure 3:
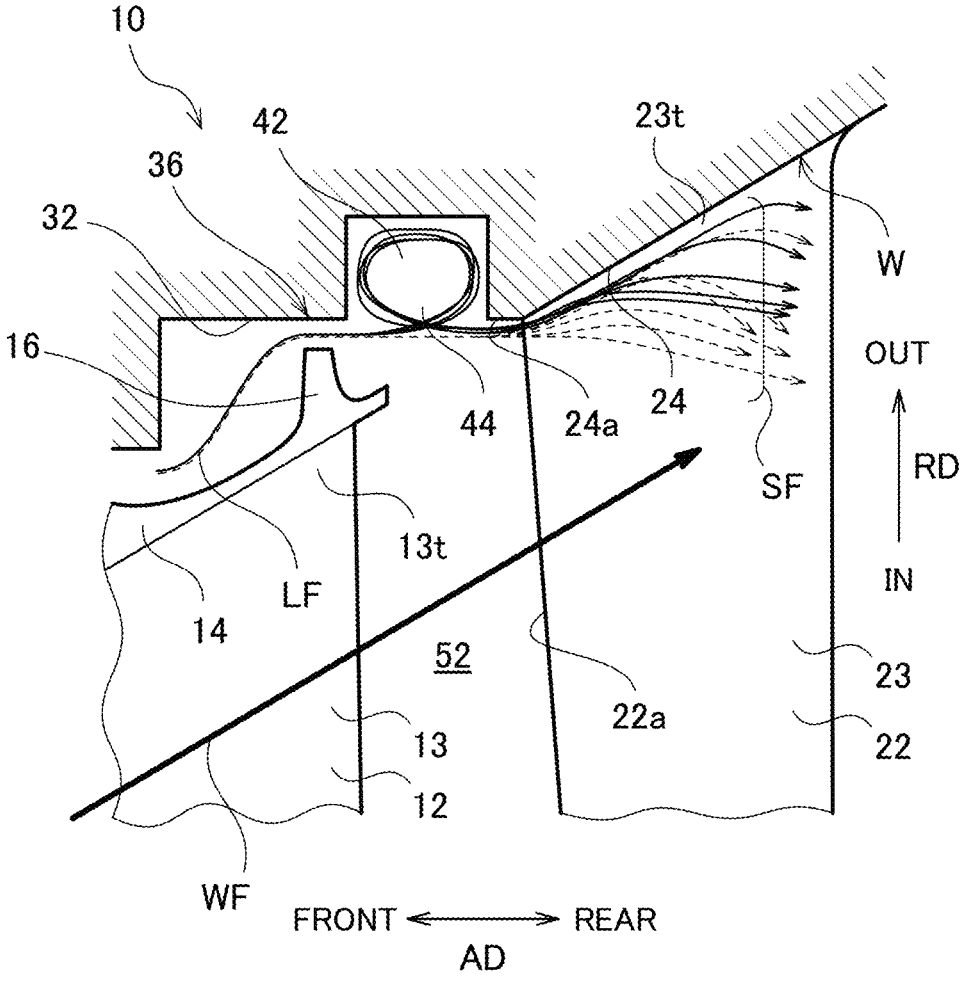
FIG. 3 is a side view illustrating changes in secondary flow caused by a cavity.
Figure 4A:
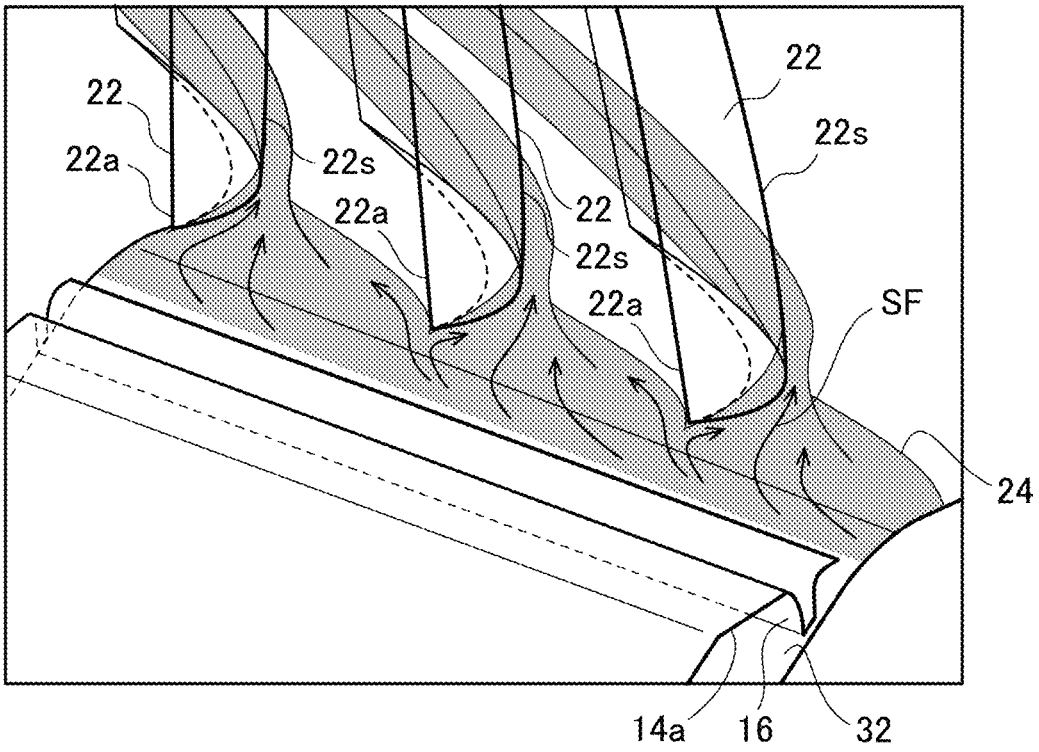
Figure 4B:
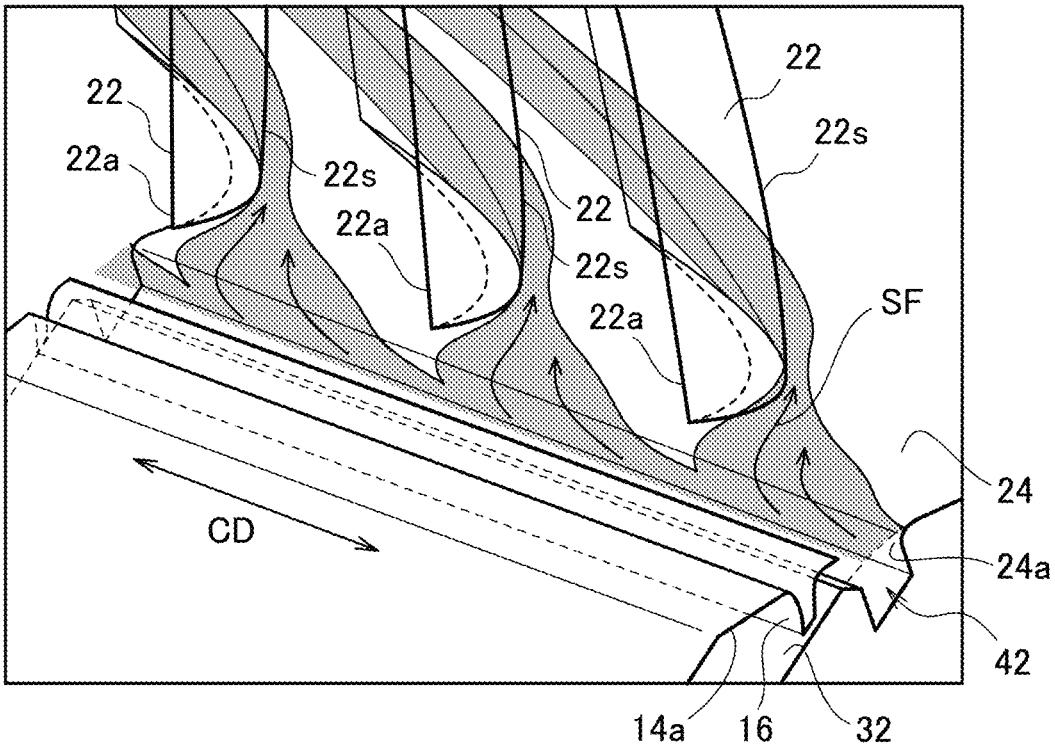

Each flow of the working fluid WF, the leakage LF, and the secondary flow SF will be described. FIG. 3 is a side view illustrating changes in the secondary flow SF caused by the cavity 42. FIGS. 4A and 4B are perspective views illustrating distributions of the secondary flow SF in the vicinity of the tip 23*t* of the stator vane 22, FIG. 4A illustrates the distribution when the cavity 42 is not present, and FIG. 4B illustrates the distribution when the cavity 42 is present. Gray indicates a space in which the secondary flow SF flows, and arrows in this space indicate the flow directions of the secondary flow SF. These distributions are based on results of the CFD analysis.

As described above, the outer shroud 14 of the rotor blade 12 includes the fin 16 that projects toward the seal surface 32. The tip 16*a* of the fin 16 is as close as possible to the seal surface 32 with the clearance described above, but is not in contact with the seal surface 32. Accordingly, the leakage LF passes between the outer shroud 14 of the rotor blade 12 and the seal surface 32, and then flows (i.e., returns) into the flow passage 52 of the working fluid WF from between the outer shroud 14 of the rotor blade 12 and the outer band 24 of the stator vane 22.

As shown in FIG. 2, the working fluid WF is already deflected by the vane cascade 25F located forward of the blade cascade 15 before flowing into the blade cascade 15. Of the working fluid WF having passed through the vane cascade 25F, the leakage LF is a flow entering the space between the outer shroud and the seal surface 32. Therefore, the leakage LF is subjected to the same deflection as the working fluid WF.

When the working fluid WF passes through the blade cascade 15, the working fluid WF is deflected by the blade cascade 15 in a direction opposite to a direction in which the vane cascade 25F deflects the working fluid WF, and flows into the vane cascade 25 located rearward of the blade cascade 15. On the other hand, the leakage LF is not deflected by the blade cascade 15 and flows into the flow passage 52 while maintaining its flow direction. Therefore, the leakage LF impinges on the suction side 22*s* at and near the leading edge 22*a* of the stator vane 22 of the vane cascade 25 at a large angle with respect to the flow direction of the working fluid WF.

This impingement of the leakage LF induces or enhances separation of the working fluid WF near the tip 23*t* on the pressure side 22*p* of the stator vane 22. Since the separation of the working fluid WF on the pressure side 22*p* is relatively large, the secondary flow SF in the vicinity of the tip 23*t* is increased, thereby resulting in a decrease in turbine efficiency. In particular, the secondary flow SF in the vicinity of the tip 23*t* is more likely to increase in the pressure side 22*p* (see FIG. 2) of the stator vane 22 than in the suction side 22*s* (see FIG. 2) of the stator vane 22.

As described above, the separation of the working fluid WF on the pressure side 22*p* results from the impingement of the leakage LF on the suction side 22*s* near the leading edge 22*a*. Therefore, in the present embodiment, the cavity 42 formed in front of the vane cascade 25 changes the original flow of the leakage LF in or near the cavity 42.

If cavity 42 is not formed, it can only flow along the seal surface 32 (or virtual surface 34). That is, the leakage LF maintains the original flow. On the other hand, when the cavity 42 is formed as shown in FIG. 3, the leakage LF flowing out of the narrow portion 36 enters the cavity 42 to form swirls as shown in FIG. 3, for example. In this case, it can be considered that the cavity 42 deflects the leakage LF toward the vane cascade 25 or moderates its speed.

In the region (space) 37 (see FIG. 2) on the front side of the vane cascade 25 in which the leading edge 22*a* of the stator vane 22 is included, a potential (i.e., a pressure field) along the circumferential direction CD becomes highest at the leading edge 22*a* of the stator vane 22 and decreases as it moves away from the leading edge 22*a*. Accordingly, the leakage LF flows away from the leading edge 22*a* of the stator vane 22 and preferentially flows in a space between the stator vane 22 and the stator vane 22 in which the potential is lower than that at the leading edge 22*a*.

Accordingly, the impingement of the leakage LF on the leading edge 22*a* and the suction side 22*s* of the stator vane 22 when the cavity 42 is present (see FIG. 4B) is mitigated compared with that when the cavity 42 is not present (see FIG. 4A). That is, the separation of the working fluid WF on the pressure side 22*p*, which is caused by the impingement on the suction side 22*s* at and near the leading edge 22*a*, is suppressed, and the increase of the secondary flow SF near the leading edge 22*a* due to the leakage LF is suppressed. Consequently, the decrease of the turbine efficiency is also suppressed.

Further, compared with the secondary flow SF when the cavity 42 is not present (indicated by dotted lines in FIG. 3), the secondary flow SF when the cavity 42 is present (indicated by solid lines in FIG. 3) is inhibited from flowing radially inward and is more likely to flow along the outer band 24. This means that the increase of the secondary flow is suppressed.

Figure 5:
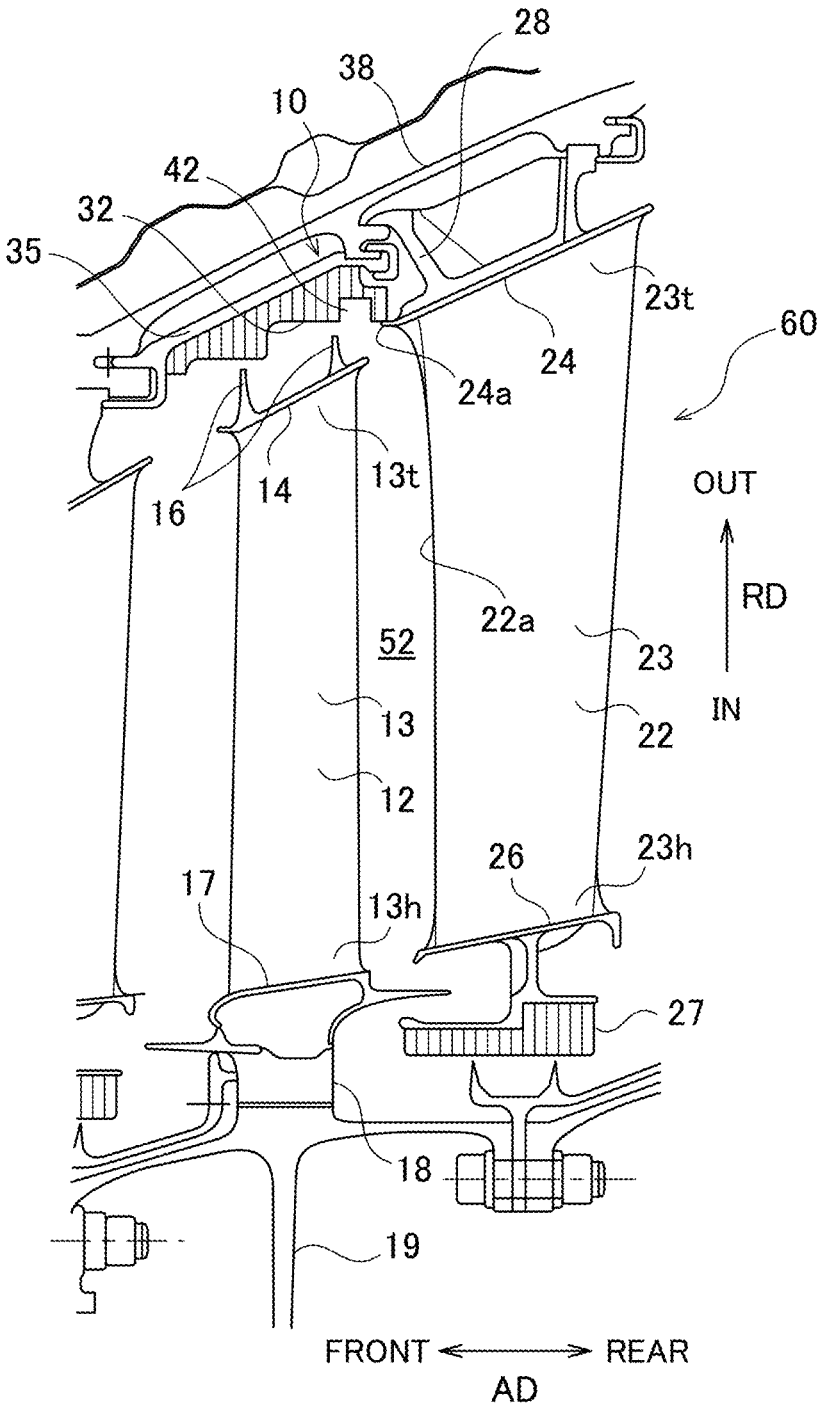
FIG. 5 is a view illustrating a part of an example of an axial turbine to which the secondary flow suppression structure is applied.

An example of a turbine 60, to which the secondary flow suppression structure 10 described above is applied, will be described. FIG. 5 illustrates a portion of the turbine 60. Here, unillustrated configurations of the turbine 60 such as the turbine shaft and others can apply known configurations.

As shown in FIG. 5, the rotor blade 12 includes an inner shroud 17 and a dovetail 18 in addition to the airfoil part 13 and the outer shroud 14 described above. The inner shroud 17 is provided at the hub 13*h* of the airfoil part 13, and the dovetail 18 is provided radially inward of the inner shroud 17. The inner shroud 17 and the dovetail 18 are integrated with the airfoil part 13. The dovetail 18 is fitted to the rotor 19, and the rotor 19 is coupled to a shaft (not shown) connected to a rotor blade of a compressor (not shown).

The stator vane 22 includes an inner band 26 and a seal member 27 in addition to the airfoil part 23 and the outer band 24 described above. The inner band 26 is provided at the hub 23*h* of the airfoil part 23, and the seal member 27 is provided radially inwardly of the inner band 26. The inner band 26 is an inner wall defining the flow passage 52 of the working fluid WF together with the inner shroud 17.

The seal surface 32 is supported with a support member 35. As shown in FIG. 5, the support member 35 is a structure interposed between the seal surface 32 and a casing 38 of the turbine 60.

The outer band 24 of the stator vane (i.e., the stator vane 22) is fixed to the casing 38 via a support member 28 such as a ring or a flange provided radially outward thereof. The support member 28 may be integrated with the outer band 24.

A gap 45 may be formed between the support member 35 of the seal surface 32 and the support member 28 of the outer band 24 (see FIG. 1). In this case, the gap 45 is connected with the cavity 42 and opens, for example, on the bottom surface 43*b* of the inner peripheral surface 43. The gap 45 has a width (a length along the axial direction AD) shorter than that of the cavity 42 at a position where the gap 45 is connected with the cavity 42. The gap 45 is intended to prevent physical interference between the support member 35 and the support member 28, and the width of the gap 45 has a value that does not interfere with the flow of the leakage LF. Thus, even if the gap 45 is formed, the effect of the cavity 42 is not lost.

It should be noted that the present disclosure is not limited to the embodiments described above, is shown by the description of the claims, and further includes all modifications within the meaning and scope of the same as the description of the claims.

What is claimed is:

1. A secondary flow suppression structure comprising:

a turbine rotor blade including an outer shroud;

a turbine stator vane located rearward of the turbine rotor blade and including an outer band;

a seal surface facing the outer shroud at a radially outside of the outer shroud; and a cavity formed between the seal surface and the turbine stator vane, formed in an annular shape extending in a circumferential direction, and provided with an opening portion opening radially inward on a virtual surface of the seal surface extending rearward; wherein the outer shroud includes a fin protruding toward the seal surface, and the cavity is formed on a member constituting the seal surface.

2. The secondary flow suppression structure according to claim 1, wherein a front end of the outer band is positioned at the same height as the virtual surface in a radial direction, or positioned radially inward of the virtual surface.

3. The secondary flow suppression structure according to claim 1, wherein the opening portion of the cavity is located rearward of a position where the fin and the seal surface face each other.

4. The secondary flow suppression structure according to claim 2, wherein the opening portion of the cavity is located rearward of a position where the fin and the seal surface face each other.

5. The secondary flow suppression structure according to claim 1, wherein:

a gap is formed between a support member of the seal surface and a support member of the outer band, and the gap is connected with the cavity and has a width shorter than that of the cavity at a position where the gap is connected with the cavity.

6. The secondary flow suppression structure according to claim 2, wherein:

a gap is formed between a support member of the seal surface and a support member of the outer band, and the gap is connected with the cavity and has a width shorter than that of the cavity at a position where the gap is connected with the cavity.

* * * * *